US005525399A

United States Patent [19]

Kiser

[11] Patent Number: 5,525,399

[45] **Date of Patent: *Jun. 11, 1996**

[54] ROOFING COMPOSITION AND METHOD

[75] Inventor: Weldon C. Kiser, Abilene, Tex.

[73] Assignee: Environmental L.L.C., Abilene, Tex.

[ * ] Notice: The term of this patent shall not extend beyond the expiration date of Pat. No. 5,453,313.

[21] Appl. No.: 474,944

[22] Filed: Jun. 7, 1995

Related U.S. Application Data

[63] Continuation-in-part of Ser. No. 187,082, Jan. 26, 1994, Pat. No. 5,453,313.

[51] Int. Cl.[6] ..... B32B 5/12

[52] U.S. Cl. ..... 428/141; 156/157; 428/143; 428/147; 428/327; 428/334; 428/492

[58] Field of Search ..... 428/141, 143, 428/147, 327, 492, 334; 156/157; 524/609, 775, 881; 52/309.1, 408, 411, DIG. 9

[56] References Cited

U.S. PATENT DOCUMENTS

| | | | |
|---|---|---|---|
| 3,547,674 | 12/1970 | Draper et al. | 428/284 |
| 3,844,668 | 10/1974 | Winters et al. | 117/168 X |
| 3,919,148 | 11/1975 | Winters et al. | 260/285 AS |
| 4,032,491 | 6/1977 | Schoenke | 524/62 |
| 4,196,115 | 4/1980 | Bresson | 524/96 |
| 4,381,357 | 4/1983 | Wettern et al. | 524/68 |
| 4,588,634 | 5/1986 | Pagen et al. | 428/283 |
| 4,640,730 | 2/1987 | Streets | 156/334 |
| 4,897,137 | 1/1990 | Miller et al. | 156/157 |
| 4,897,443 | 1/1990 | Robinson et al. | 524/609 |

*Primary Examiner*—D. S. Nakarani
*Assistant Examiner*—H. Thi Le
*Attorney, Agent, or Firm*—John L. Sigalos

[57] ABSTRACT

There are disclosed novel polysulfide roofing compositions, combined with rubber particle mats, and bituminous-based roofing compositions containing crumb rubber and an elastomeric polysulfide to give improved impact resistance and the method of making such roofing.

19 Claims, 1 Drawing Sheet

ROOFING COMPOSITION AND METHOD

CROSS-REFERENCE TO RELATED APPLICATION

The instant application is a continuation-in-part of U.S. application Ser. No. 08/187,082 filed Jan. 26, 1994, now U.S. Pat. No. 5,453,313.

BACKGROUND OF THE INVENTION

The present invention relates to novel bituminous-based roofing compositions comprising a bituminous material suitable for roofing, crumb rubber, and a polysulfide, to the method of forming such roofing, and to improved polysulfide roofing.

The parent application, whose entire specification, drawings, and claims are specifically incorporated herein by reference, discloses novel roofing, including roofing shingles utilizing elastomeric polysulfides. Such roofing is resistant to cracking and hail damage. Due to the cost of polysulfides, such roofing is costlier than existing roofing compositions and shingles and can mitigate against its usage.

Presently, low cost materials for roofing are bituminous materials, such as asphalt. Roofing asphalts, typically Types I through IV, are commonly used to form roofing. For use on flat roofs, they are delivered, usually in block form, to an asphalt kettle where the asphalt is heated to a molten or liquid state and the molten asphalt then applied to a surface to form the roofing. After application, the asphalt solidifies back to its rigid state. Asphalt shingles have also been used.

Among the many problems with roofing asphalts is the fact that they are brittle, particularly at low temperatures, have poor structural strength, and upon exposure to the elements they tend to crack and suffer degradation from ultraviolet radiation. As a consequence, they do not have suitable service life and are susceptible to severe damage by hail. Efforts to overcome some of the defects of such type of roofing is to include certain types of polymers with the asphalt, such as is shown, for example, in U.S. Pat. Nos. 4,032,491 and 4,196,115. These are done in an effort to make the asphalt roofing less brittle and to have suitable properties at low temperature. Other efforts to improve the undesirable properties of the asphalt include the addition thereof of rubber crumb layers, as is shown in U.S. Pat. No. 3,547,674.

However, none of these compositions discussed above in the prior art has sufficient strength and resistance to damage from hail. The brittle nature of the asphalt is such that none of the prior art compositions discussed above has suitable low temperature properties, resistance to UV degradation, as well as impact-resistance so as to resist hail damage.

SUMMARY OF THE INVENTION

The present invention overcomes the problems of the prior art and provides durable asphalt roofing compositions and a method of making the same.

Briefly stated, the present invention comprises a roofing composition comprising a bituminous-based material suitable for roofing, crumb rubber, and an elastomeric polysulfide. The invention also comprises polysulfide roofing as hereinafter described that is free of bituminous-based material.

The present invention further comprises a method of forming roofing, as more fully set forth hereinbelow.

DETAILED DESCRIPTION

Figure 1:
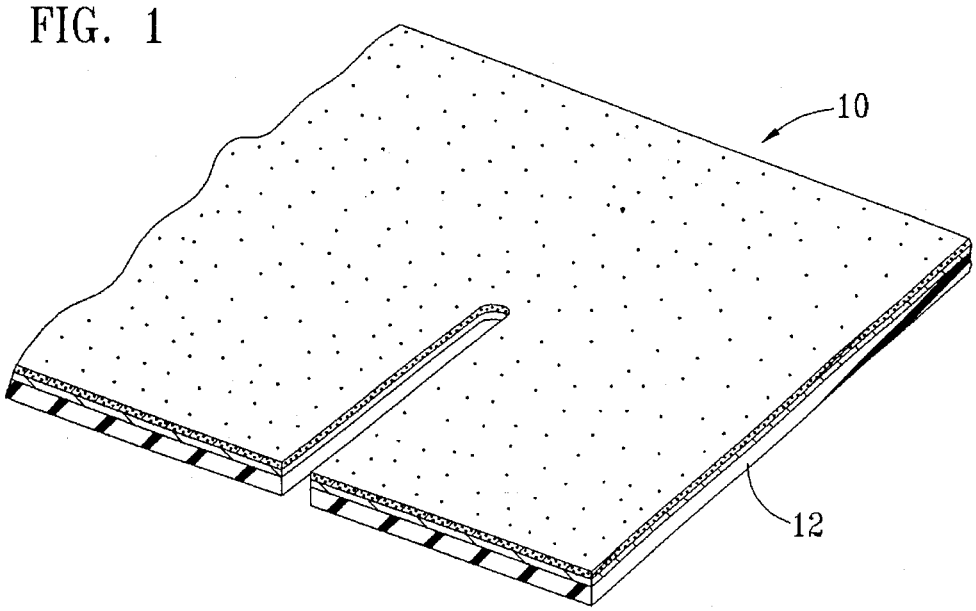
FIG. 1 is a perspective view, partially broken away, showing an elastomeric polysulfide roofing of the present invention in the form of a shingle.

The essential elements of the bituminous roofing composition of the present invention is a bituminous-based material suitable for roofing, crumb rubber, and an elastomeric polysulfide.

With respect to the bituminous-based material, it is preferred to utilize a conventional roofing asphalt, namely Types I through IV. In this application, Asphalt types I through IV indicate asphalts having softening point of 135°–151° F., 158°–176° F., 185°–205° F. and 210°–225° F., respectively, measured according to ASTM-D 312-84. While other conventional roofing asphalts can be utilized, it is preferred to use these materials because of their low cost. The particular temperature at which these materials can be put into molten form is about 380 to 520° F. and the particular asphalt utilized will depend on the degree of pliability desired, and is well known to those skilled in this art.

As to the crumb rubber, any crumb rubber can be used, such crumb rubber particles being made from scrap rubber materials such as old tires, sidewall, and carcass buffings. It is also possible to utilize other scrap rubber materials and even styrene-butadiene rubber crumbs. While various particle sizes can be utilized, it is preferred to use mesh sizes ranging from about 20 to 40 mesh U.S. Standard.

The third essential component of the instant invention is the utilization of a polysulfide, preferably a hot melt polysulfide rubber. Such polysulfides are gel types and are available from Morton International, one particular one having the designation "ZR2507". These have various viscosities, a preferable viscosity being a Brookfield viscosity of about 3 poise, but higher viscosities can be utilized. Such polysulfide materials are, of course, elastomeric and contain conventional curing agents. Ordinarily the chemical reaction is such that a liquid polysulfide rubber will cure within 24 hours at normal ambient conditions; namely, over about 40° F. Consequently, it is not recommended that it be applied at a temperature lower than 40° F.

As is conventional, other materials can be added to the composition to minimize ultraviolet degradation and to provide fire resistance and self-extinguishing properties and, if desired, to increase the strength. Such materials include the usual conventional ultraviolet absorbers and fillers, such as silicates, carbonates, and carbon black. Use of crumb rubber which contains amounts of such fillers and UV absorbers usually eliminates the need to add additional amounts of such additives. It is also customary to add roofing aggregate as a top surface of the roofing.

For fire retardancy, however, it is preferred to use roofing aggregate by-product dust. Such by-product dust is left over when aggregate is ground to make the conventional roofing aggregate that is placed on roofing and on shingles. It has been found, surprisingly, that such roofing aggregate by-product dust gives excellent fire retardancy, and greatly reduces the flaming of the roofing materials.

With respect to proportions, the asphalt is the major component and for each 100% by weight thereof there is added about 5 to 70% by weight elastomeric polysulfide and 10 to 35% by weight crumb rubber. It is preferred to use the lowest amount of polysulfide required to give hail resistance in order to minimize the amount of costly polysulfide used. As a rule the colder the geographical area in which the roofing is to be used the greater the amount of polysulfide needed to ensure the desired properties. In the colder climates, more of the polysulfide is required in order to have the proper flexibility of the composition due to the brittleness of asphalt at low temperatures.

The roofing aggregate by-product dust which is used as a fire retardant can also function as a filler and strengthener of the composition and can be used at ranges of 10 to 50% by weight for each 100% by weight of asphalt, preferably about 25 to 30. Such amount of retardant does lower the elasticity and elongation of the composition, but it is important in that it gives the desired fire retardancy necessary for asphaltic roofing.

The method of preparing the composition for flat roofing is to first heat the asphalt which is usually sold in block form in order to bring it to the molten state, usually depending upon the type of roofing asphalt used, a temperature of about 380° to 520° F. To this composition in a conventional roofing kettle is added the polysulfide and crumb rubber, together with the other components of the mix, such as the additives noted above, and particularly the fire retardant materials, and the mass thoroughly admixed. This molten composition can then be applied by any of the means conventionally utilized in applying roofing asphalt; namely, by being trowelled, pumped, brushed sprayed, or mopped onto any number of conventional roofing substrates. It will also be obvious that this composition can be applied as a new coating over old roofing. At the higher temperatures and with the finer size crumb rubber particles, such particles will also become molten and lose their particle form. However, the resultant rubber becomes dispersed throughout the composition and still exerts its beneficial effect.

It is a feature of the instant invention that the composition can be made as described above in a manufacturing facility and packaged in block form as is the case with unmodified roofing asphalt. It can then be taken to the job site and melted for application without any need to add and admix any components.

It is preferred in forming new roofing and in using the composition over old roofing, to use a mat on the surface of the already formed roof, such mat being preferably made of crumb rubber, but conventional fiberglass roofing mats can be utilized, such as types used for Class A, B, or C, or even non-rated roofing shingles. Also, the conventional roofing felt used for built-up-roofing is suitable, as is organic felt. All of these are conventionally used in making roofing.

It is preferred to use a mat made of crumb rubber in which the crumb rubber particles are held together with a polysulfide rubber. This acts to more firmly bond to the mat the composition of the instant invention.

For other than flat roofing, self-supporting roofing shapes such as shingles, shakes, tiles, panels, and other overlapping roofing unit types can be made. Their manufacture is accomplished in the usual manner by first forming the composition as discussed above and then forming the same into the shape desired by the usual techniques. This includes the cutting of the composition when cured into the shape desired and, as is conventional, having the outer surface of the shingles, for example, covered with a roofing aggregate. It is also possible to color the shapes with a decorative color, as is conventional, using the materials conventional for this purpose for asphalt shingles. The composition can be used alone to form the shape, or applied to any suitable roofing base material. The thickness of the shingles can vary widely, as is common for shingles and other roofing shapes.

The parent application discloses roofing in which an elastomeric polysulfide layer containing crumb rubber particles is used. It has now been found that suitable roofing can be prepared without any crumb rubber particles in said layer. Such polysulfide roofing product comprises a rubber particle mat base having at least one outer layer of an elastomeric polysulfide. The polysulfides used, as well as the rubber particle mat bases, are those disclosed in the parent application. It is preferred to use a polysulfide as the binder for the particles in making the roofing, as this makes for better binding of the polysulfide outer layer to the mat.

Referring to the drawings, FIG. 1 shows shingle 10 comprising the composition described above in its cured and shaped form as an individual overlapping unit placed over a conventional mat 12. Shingle 10 has roofing aggregate 13 distributed over its outer surface.

Figure 2:
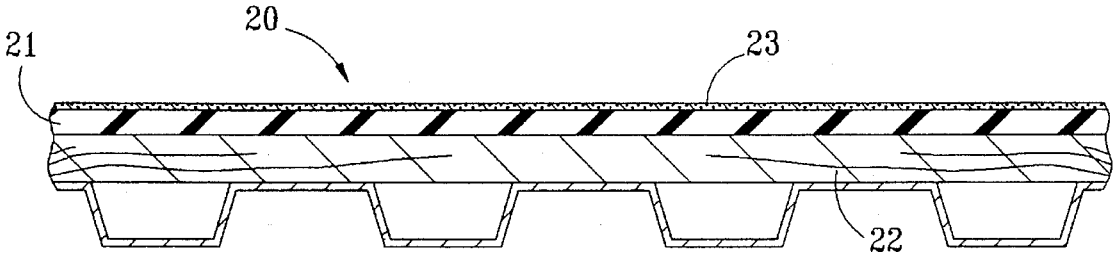
FIG. 2 is a partial sectional view of a new roofing structure in accord with the present invention.

Reference to FIG. 2 shows a roofing structure 20 in accord with the present invention and suitable for use on a flat or shed roof in which, preferably, mat 21 is applied over conventional roof decking 22. While a single mat roll is shown it is possible to use individual pieces of mat that are placed against each other. The edges of the butted-together mats are sealed using conventional self-adhesive or fabric tapes using the composition 23 applied as the roofing layer. The composition in molten form is applied by mopping, trowelling, spraying, or any other conventional technique used in applying roofing asphalts. This forms a waterproof seam and also provides an expansion-type joint. Again, more than one layer of composition can be used and also refractory aggregate can be applied thereover.

Figure 3:
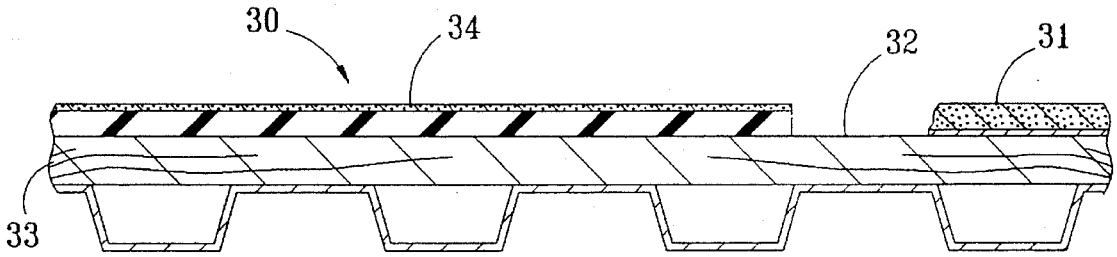
FIG. 3 is a partial sectional view of the present invention applied to a fully spudded existing roof.

FIG. 3 illustrates the utilization of the present invention on an existing built-up roof 30. The existing gravel and asphalt 31 are removed by the conventional spud process to expose the decking 32. There is then preferably applied thereover any conventional mat 33, which is adhered to the decking with a quick set adhesive or the like, and the composition 34 applied thereover as described in connection with FIG. 2. Again, more than one layer of composition 34 can be used.

The invention will be further described in connection with the following examples which are set forth for purposes of illustration only.

EXAMPLES

A series of test roofing shapes were prepared in the form of 12 inch by 12 inch squares from the following composition:

| | | % by Wt. |
|---|---|---|
| 1. | Roofing asphalt (Type III) | 100 |
| 2. | Additives | |
| (a) | Polysulfide rubber (gel type-ZR2507) | 5 |
| (b) | Crumb rubber (40 mesh) | 35 |
| (c) | Fire retardant (roofing aggregate by-product dust) | 50 |

The shapes were formed by heating the asphalt to a temperature of 485° F. to melt the same and the additives admixed therewith to form a homogeneous mass which was kept at the noted temperature for 45 minutes. It was noted that the crumb rubber particle melted.

The composition was then brushed onto a commercial crumb rubber roofing mat to the usual thickness for asphalt roofing and roofing aggregate placed on and pressed into the upper surface of the composition. The composition-coated mat was permitted to come back to ambient temperature and gel, cut into 12-inch squares, and permitted to cure for 1 day before testing.

Portions of the composition of the same thickness as the coating on the mat where placed on tinfoil and put into a freezer at 27° F. As a comparison the Type III roofing asphalt alone, without any additives, was also coated at the same thickness on tinfoil and also placed in the freezer. After one-half hour at that temperature the tinfoil-coated specimens were removed from the freezer and each specimen grasped on two sides and flexed to an approximately 30° angle. Those specimens comprising the composition of the instant invention remained flexible without cracking or breaking. The specimens coated with Type III asphalt only, cracked and broke.

The shapes after curing were tested for impact resistance by projecting ice stones against the shapes at a velocity of 50 to 106 m.p.h. The same test was conducted against the following commercial shingles, some of which are asphalt or resin-modified asphalt shingles: ELCOR, GAF, OWENS-CORNING, AMERICAN CEMWOOD (cement/wood fiber), IKO MANUFACTURING, and TAMKO Asphalt Products. The stones were formed with the following diameters (in inches), 0.75, 1, 1.25, 1.5, and 1.75, and were projected from the smallest size to the next size until all sizes were projected or there was penetration.

The shapes of the present invention showed no adverse effect. They were still flexible and resistant to penetration, whereas the commercial shingles all showed damage with 1-inch stones, and all showed this penetration with 1.25-inch ice stones.

The compositions of the present invention coated on the foil were reheated to melt the same and regelled for six additional times without showing any degradation, phase separation, or any other adverse effect, and remained flexible. This shows the ability to make the compositions of the instant invention at a central manufacturing facility, to package the same, and to distribute the same for use at various job sites by simply remelting the same.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A roofing composition comprising a bituminous material suitable for roofing, as the major component crumb rubber, and an elastomeric polysulfide.

2. The roofing composition of claim 1 wherein the bituminous material is a Type I, Type II, Type III, or Type IV roofing asphalts.

3. The roofing composition of claim 2 wherein the crumb rubber has a mesh size of about 20 to 40 mesh.

4. The roofing composition of claim 3 wherein the polysulfide is a polysulfide gel.

5. The roofing composition of claim 1 wherein for each 100% by weight of bituminous material there is about 5 to 70% by weight elastomeric polysulfide and 10 to 35% by weight crumb rubber.

6. The roofing composition of claim 5 including a fire retardant.

7. The roofing composition of claim 6 wherein for each 100% by weight bituminous material there is about 10 to 50% by weight roofing aggregate by-product dust as a fire retardant.

8. The roofing composition of claim 1 in the form of a self-supporting roofing shape.

9. The roofing composition of claim 8 wherein said shape is a shingle.

10. A polysulfide roofing product comprising a rubber particle mat base having at least one outer layer of an elastomeric polysulfide.

11. The roofing product of claim 10 wherein said rubber mat comprises rubber particles bonded together with an elastomeric polysulfide.

12. The method of forming a roofing comprising liquefying a bituminous material suitable for roofing, adding to said liquefied material crumb rubber particles and an elastomeric polysulfide, mixing the material, crumb rubber particles, and elastomer polysulfide to form a substantially uniform admixture thereof in which the bituminous material is the major component, and applying said admixture to form said roofing.

13. The method of claim 12 wherein the bituminous material is a Type I, Type II, Type III, or Type IV roofing asphalts.

14. The method of claim 13 wherein the crumb rubber has a mesh size of about 20 to 40 mesh.

15. The method of claim 14 wherein the polysulfide is a gel-type polysulfide.

16. The method of claim 12 wherein for each 100% by weight of bituminous material there is about 5 to 70% by weight elastomeric polysulfide and 10 to 35% by weight crumb rubber.

17. The method of claim 16 including a fire retardant in said composition.

18. The method of claim 17 wherein for each 100% by weight bituminous material there is about 10 to 50% by weight roofing aggregate by-product dust as a fire retardant.

19. The roofing product of claim 10 consisting essentially of a rubber mat consisting essentially of crumb rubber particles bonded together with an elastomeric polysulfide having on at least one outer surface thereof a layer of an elastomeric polysulfide.

* * * * *